US011986060B2

(12) United States Patent
Cheng et al.

(10) Patent No.: US 11,986,060 B2
(45) Date of Patent: May 21, 2024

(54) STRAP TIP STRUCTURE

(71) Applicant: TAIWAN PAIHO LIMITED, Chang Hwa Hsien (TW)

(72) Inventors: Allen Cheng, Chang Hwa Hsien (TW); Chan-Lu Chang, Chang Hwa Hsien (TW); Chia-Ju Cheng, Chang Hwa Hsien (TW); Yi-Jhen Su, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 0 days.

(21) Appl. No.: 18/169,840

(22) Filed: Feb. 15, 2023

(65) Prior Publication Data

US 2024/0041161 A1 Feb. 8, 2024

(30) Foreign Application Priority Data

Aug. 4, 2022 (TW) ..... 111129274

(51) Int. Cl.
*A43C 9/06* (2006.01)

(52) U.S. Cl.
CPC ..... *A43C 9/06* (2013.01)

(58) Field of Classification Search
CPC ... A43C 9/06; Y10T 24/3795; Y10T 24/3969; Y10T 24/3797; Y10T 24/3789; Y10T 403/7054; Y10T 403/7056; F16B 2/065; F16G 11/02; F16G 11/025
See application file for complete search history.

(56) References Cited

U.S. PATENT DOCUMENTS 1,392,339 A * 10/1921 Kelly ..... A43C 9/06 24/715.6
1,420,632 A * 6/1922 Kelly ..... A43C 9/06 24/715.6
2,699,589 A * 1/1955 Redell ..... F04B 27/047 294/102.1
4,455,717 A * 6/1984 Gray ..... F16G 11/025 24/115 M (Continued)

FOREIGN PATENT DOCUMENTS

CN 216776298 U 6/2022
TW M380022 U 5/2010
TW M639995 U 4/2023

*Primary Examiner* — Robert Sandy
*Assistant Examiner* — Rowland Do
(74) *Attorney, Agent, or Firm* — CKC & Partners Co., LLC

(57) ABSTRACT

A strap tip structure includes a positioning fastener member and an outer cover. The positioning fastener member includes a mainbody, at least three clip members and an external screw structure. The at least three clip members are flexibly connected to the mainbody, and each of the clip members is an arc plate and has an end portion. The external screw structure is disposed on an outer surface of the mainbody. The outer cover is detachably connected to the positioning fastener member. The outer cover includes an inner space and an inner screw structure, and the inner screw structure matches the external screw structure. When the inner screw structure of the outer cover and the external screw structure of the positioning fastener member are screwed together, the positioning fastener member is accommodated in the inner space.

10 Claims, 7 Drawing Sheets

(56) References Cited

U.S. PATENT DOCUMENTS

| | | | | | |
|---|---|---|---|---|---|
| 4,939,831 | A * | 7/1990 | Doninger | B25B 33/00 | 29/263 |
| 5,170,538 | A * | 12/1992 | Zarembo | F16G 11/02 | D8/367 |
| 5,289,613 | A * | 3/1994 | Kohl | F16G 11/02 | 16/108 |
| 5,594,977 | A * | 1/1997 | McCallion | E04G 17/0707 | 52/223.13 |
| 7,246,417 | B1 * | 7/2007 | Huang | A43C 1/00 | 24/715.6 |
| 2005/0132546 | A1 * | 6/2005 | Cheng | A43C 9/06 | 24/715.4 |
| 2008/0295305 | A1 * | 12/2008 | Hsu | A43C 9/04 | 24/715.6 |
| 2014/0033486 | A1 * | 2/2014 | Beaufrere | A43C 9/06 | 24/715.6 |

* cited by examiner

STRAP TIP STRUCTURE

RELATED APPLICATIONS

This application claims priority to Taiwan Application Serial Number 111129274, filed Aug. 4, 2022, which is herein incorporated by reference.

BACKGROUND

Technical Field

The present disclosure relates to a strap positioning structure. More particularly, the present disclosure relates to a strap tip structure for positioning a tip of a strap.

Description of Related Art

A webbing strap is a long fabric having a woven form and can be used in many different fields such as clothing and daily necessities. However, after a period of use, the tip of the webbing strap often unravels due to the decrease in the structural strength thereof, resulting in the webbing strap being unable to pass through holes in an article, and the use efficiency of the webbing strap being reduced. Further, if the unraveling condition of the tip spreads to the entire webbing strap, the webbing strap is unusable and needs to be replaced.

In order to solve the aforementioned problem, a webbing strap head formed by bonding a plastic sheet to cover the tip of the webbing strap is provided in the market. Such a configuration is favorable for reducing and delaying the wear and tear of the webbing strap when the webbing strap is used, and the unraveling condition of the webbing strap can be prevented. However, the webbing strap head made of the plastic sheet is still insufficient in strength, the damage rate thereof is also high, and reuse by replacing the plastic sheets is not possible.

Furthermore, the length of the webbing strap having a head structure is usually fixed, and if the length is too long, the webbing strap must be processed by tying or cutting so as to adjust the webbing strap to a suitable length. However, while adjusting the length of the webbing strap by tying can maintain the head structure of the webbing strap, the overall appearance thereof may be affected due to the entangled knots on the webbing strap. Further, trimming the length of the webbing strap by cutting will remove the head structure of the webbing at the same time. Thus, performing such trimming may cause the webbing strap to unravel during the use thereof, and the strength of the webbing strap may be greatly reduced.

Therefore, how to improve the head structure of the webbing strap has become a commercial issue with economic value.

SUMMARY

According to one aspect of the present disclosure, a strap tip structure includes a positioning fastener member and an outer cover. The positioning fastener member has a strap positioning space and includes a mainbody, at least three clip members and an external screw structure. The mainbody has an accommodating space. The at least three clip members are flexibly connected to the mainbody. Each of the at least three clip members is an arc plate and has an end portion, and the end portion is away from the mainbody. The external screw structure is disposed on an outer surface of the mainbody. The positioning fastener member gradually expands along a direction from the mainbody to the end portion of each of the at least three clip members. The accommodating space and the at least three clip members define the strap positioning space, and the strap positioning space is for positioning a strap. The outer cover is detachably connected to the positioning fastener member, wherein the outer cover includes an inner space and an inner screw structure. The inner screw structure is disposed on an inner surface of the outer cover, and the inner screw structure matches the external screw structure. When the inner screw structure of the outer cover and the external screw structure of the positioning fastener member are screwed together, the positioning fastener member is accommodated in the inner space, and the end portion of each of the at least three clip members protrudes from the outer cover.

BRIEF DESCRIPTION OF THE DRAWINGS

The present disclosure can be more fully understood by reading the following detailed description of the embodiment, with reference made to the accompanying drawings as follows.

DETAILED DESCRIPTION

The present disclosure will be further exemplified by the following specific embodiments with the drawings so as to facilitate utilizing and practicing the present disclosure completely by those skilled in the art without over-interpreting and over-experimenting. However, the readers should understand that the present disclosure should not be limited to these practical details. That is, in some embodiments, these practical details are used to describe how to implement the materials and methods of the present disclosure and are not necessary.

Figure 1:
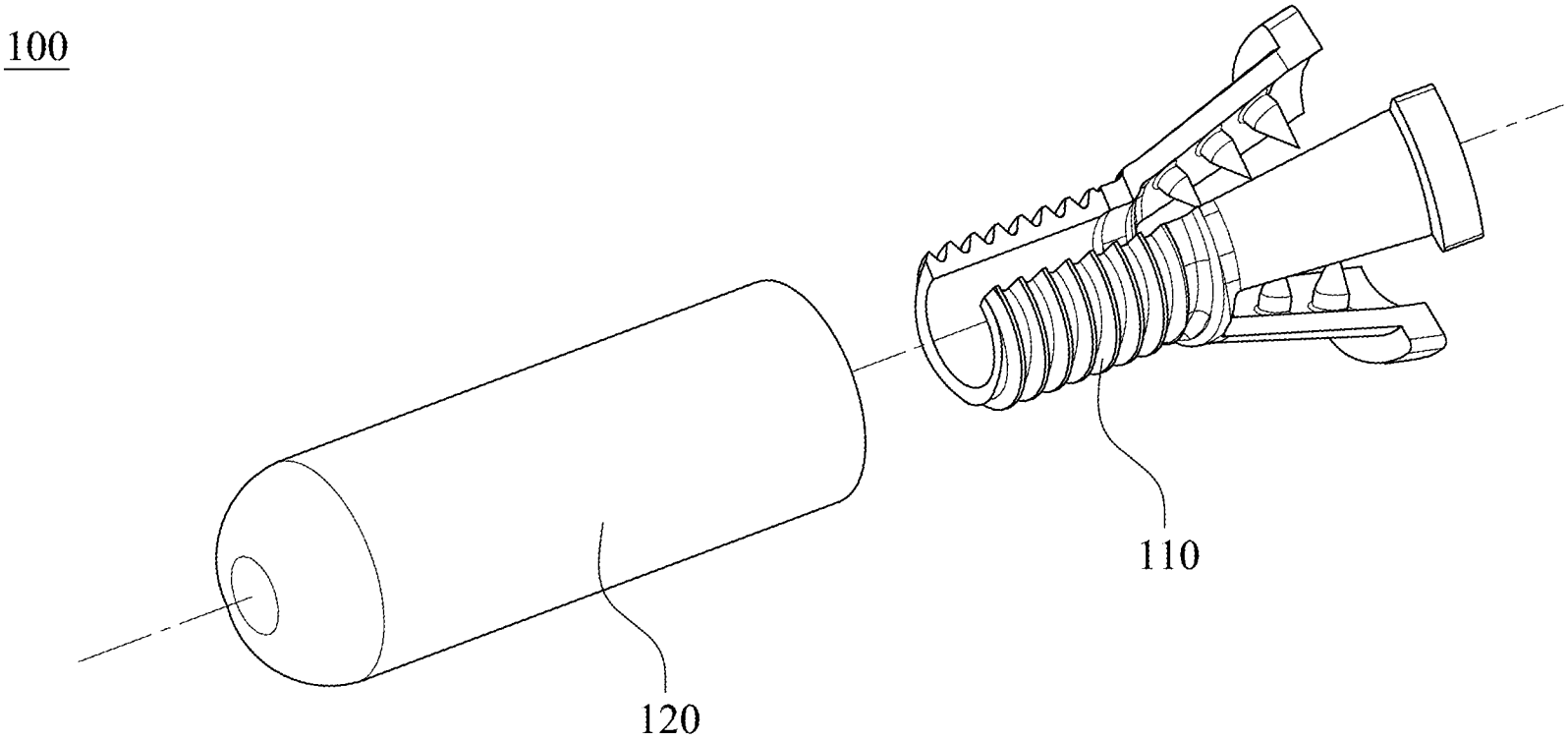
FIG. 1 is a schematic view of a strap tip structure according to one embodiment of the present disclosure.

Reference is made to FIG. 1, which is a schematic view of a strap tip structure 100 according to one embodiment of the present disclosure. The strap tip structure 100 includes a positioning fastener member 110 and an outer cover 120.

Figure 2:
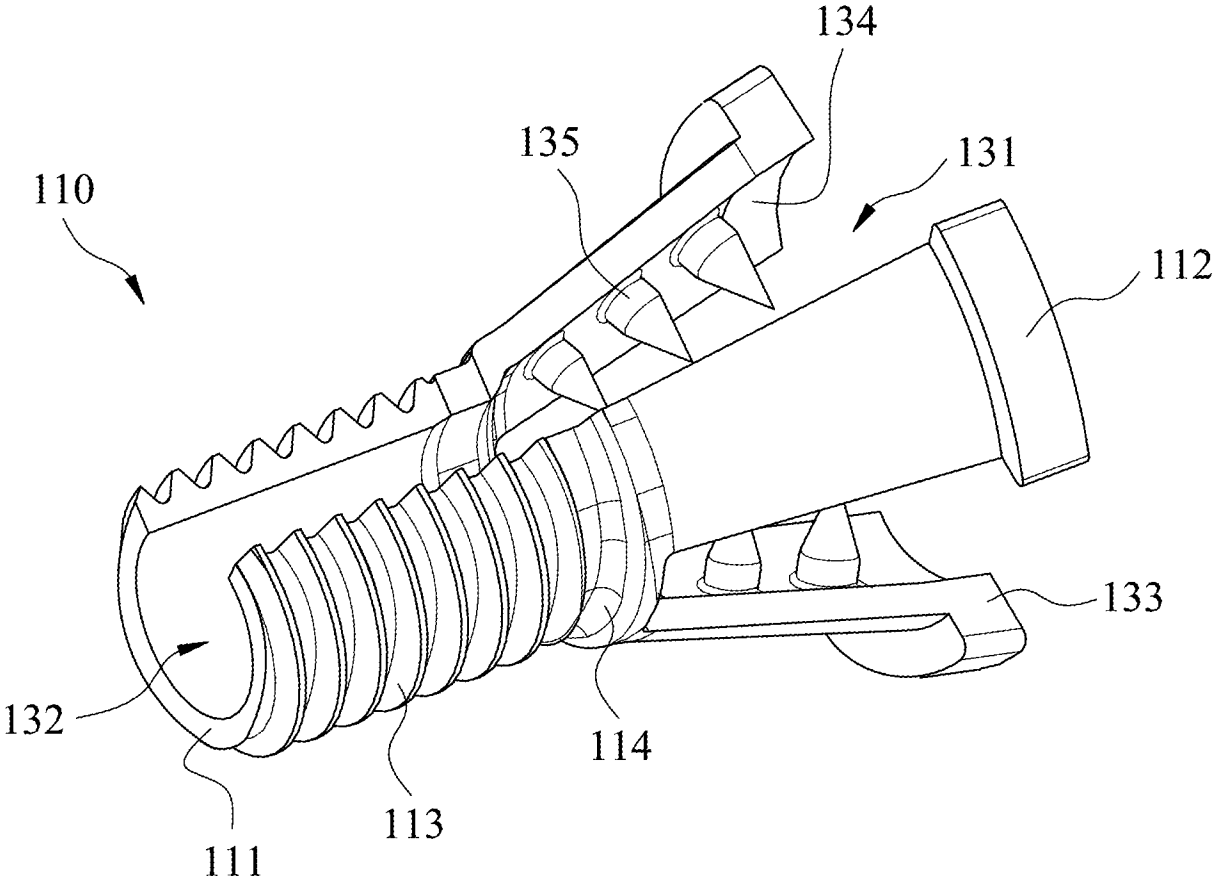
FIG. 2 is a schematic view of a positioning fastener member of the strap tip structure of FIG. 1.
Figure 3:
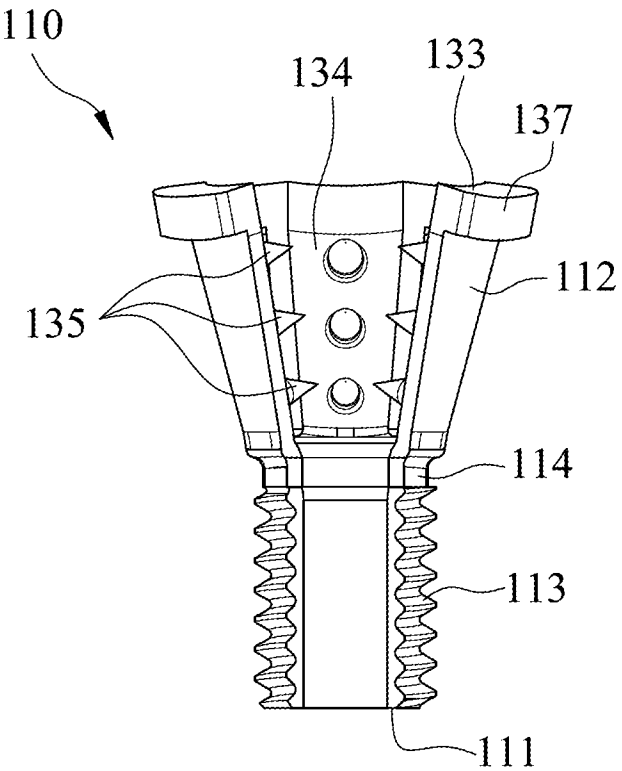
FIG. 3 is another schematic view of the positioning fastener member of FIG. 2.

Reference is made to FIG. 1, FIG. 2 and FIG. 3 simultaneously, wherein FIG. 2 is a schematic view of the positioning fastener member 110 of the strap tip structure 100 of FIG. 1, and FIG. 3 is another schematic view of the positioning fastener member 110 of FIG. 2. As shown in FIG. 2 and FIG. 3, the positioning fastener member 110 includes a mainbody 111, at least three clip members 112 and an external screw structure 113.

The mainbody 111 has an accommodating space 132. In greater detail, in the strap tip structure 100, the mainbody 111 can be substantially a cylindrical cotter pin, so that the shape of the mainbody 111 is a cylindrical C-shaped clip. Thus, the mainbody 111 not only has a stable elastic force to clamp a strap, but also has excellent wrapping properties to be applied to straps with different diameters. Therefore, the application range of the strap tip structure 100 of the present disclosure can be greatly improved.

The clip members 112 are flexibly connected to the mainbody 111, wherein each of the clip members 112 is an arc plate and has an end portion 133, and the end portion 133 is arranged on a side of the clip member 112 away from the mainbody 111. By the arrangement of the clip members 112 in a manner flexibly connected to the mainbody 111, each of the clip members 112 can be repeatedly bent relative to the mainbody 111. Such a configuration is favorable for replacing the strap positioned therein, and the use of the strap tip structure 100 of the present disclosure can be convenient.

The external screw structure 113 is disposed on an outer surface (the reference number is omitted) of the mainbody 111. Further, the external screw structure 113 can be a right-hand thread structure or a left-hand thread structure, and the present disclosure is not limited thereto.

As shown in FIG. 2 and FIG. 3, the positioning fastener member 110 gradually expands along a direction from the mainbody 111 to the end portion 133 of each of the clip members 112, and the positioning fastener member 110 has a strap positioning space 131 (the reference number is shown in FIG. 2). The strap positioning space 131 is defined by the accommodating space 132 of the mainbody 111 and the at least three clip members 112, and the strap positioning space 131 is for positioning a strap (not shown). Therefore, the arrangement in which the positioning fastener member 110 gradually expands along the direction from the mainbody 111 to the end portion 133 of each of the clip members 112 is favorable for placing the strap into the strap positioning space 131, and a clamping force from the outer surface of the strap to a center thereof can be obtained when the positioning fastener member 110 is connected to the outer cover 120. Thus, the use of the strap tip structure 100 of the present disclosure can be convenient.

As shown in FIG. 2 and FIG. 3, the positioning fastener member 110 can further include a flexible connecting portion 114, and the at least three clip members 112 are connected to the mainbody 111 through the flexible connecting portion 114. Such a configuration is favorable for increasing the mobility of the clip members 112 relative to the mainbody 111 while maintaining the overall structural strength thereof.

Figure 4:
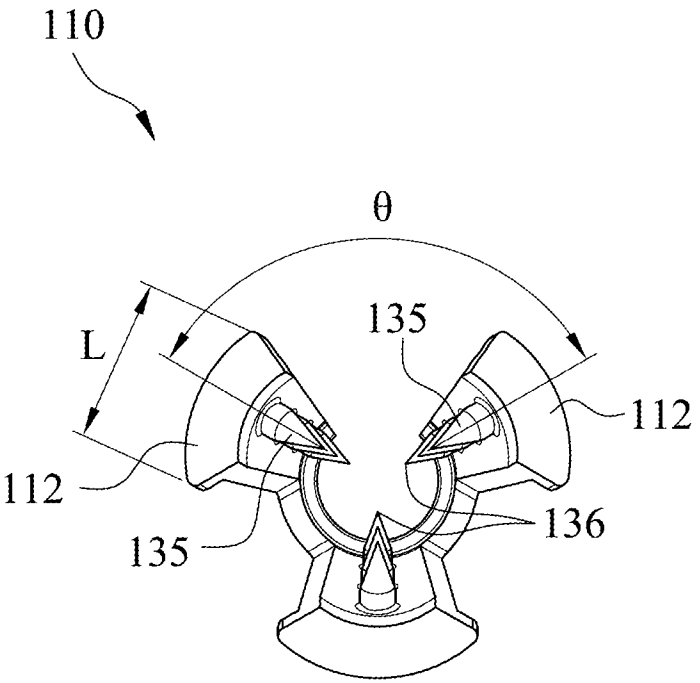
FIG. 4 is a schematic view of the positioning fastener member of FIG. 2 observed from clip members thereof.

Reference is made to FIG. 3 and FIG. 4, wherein FIG. 4 is a schematic view of the positioning fastener member 110 of FIG. 2 observed from the clip members 112 thereof. As shown in FIG. 4, the at least three clip members 112 are separated from each other and integrally connected to the mainbody 111 equidistantly, and a width L of the end portion 133 of each of the clip members 112 perpendicular to a long axis of the mainbody 111 is less than ⅓ of a circumference of the mainbody 111. In greater detail, in the present embodiment, a number of the clip members 112 is three, the outer side and the inner side of each of the clip members 112 are arc-shaped, and the mainbody 111 is also shaped as a cylindrical cotter pin. When the three clip members 112 are squeezed by the outer cover 120, the three end portions 133 of the three clip members 112 will be moved close to each other. At the same time, because the three clip members 112 are separated from each other and equidistantly disposed on the mainbody 111, and the width L of the end portion 133 of each of the clip members 112 perpendicular to the long axis of the mainbody 111 is less than ⅓ of the circumference of the mainbody 111, the structure of the positioning fastener member 110 will be gradually changed to a hollow cylinder from a gradually expanding shape when the three clip members 112 are closed together. Moreover, the three clip members 112 will not overlap with each other when the positioning fastener member 110 becomes the hollow cylinder. Thus, the effect of completely covering the strap so as to achieve a stable clamping ability can be achieved. Further, angles and spaces required for opening molds can be provided by the arrangement in which the three clip members 112 are separated from each other and integrally connected to the mainbody 111 equidistantly, and thus the mass production of the positioning fastener member 110 can be more efficient. Furthermore, a width of each of the clip members 112 can gradually increase along a direction from the connection with the mainbody 111 to the end portion 133, but the present disclosure is not limited thereto.

Reference is made to FIG. 2, FIG. 3 and FIG. 4. Each of the clip members 112 can further include an inner arc surface 134 and at least two teeth structures 135. The inner arc surface 134 faces the strap positioning space 131. The at least two teeth structures 135 are disposed on the inner arc surface 134, and the at least two teeth structures 135 of each of the clip members 112 are arranged along a long axis thereof. In particular, in the strap tip structure 100, a number of the teeth structures 135 of one clip member 112 is three, and the three teeth structures 135 are separately and equidistantly disposed on the inner arc surface 134 of the clip member 112 along the long axis thereof. The teeth structures 135 can position the strap when the strap is placed in the strap positioning space 131, and the teeth structures 135 can further penetrate into the inner material of the strap when the clip members 112 are squeezed by the outer cover 120 subsequently. Thus, the effect of fixing the strap can be enhanced.

Further, as shown in FIG. 4, each of the teeth structures 135 includes a tip portion 136, and the tip portion 136 of each of the teeth structures 135 of the clip member 112 faces toward a central axis (the reference number is omitted) of the positioning fastener member 110. Furthermore, in the positioning fastener member 110, an angle θ between one of the teeth structures 135 of one of the clip members 112 and one of the teeth structures 135 of another one of the clip members 112 adjacent thereto parallel to a cross-section of the positioning fastener member 110 can be less than or equal to 120 degrees. By the arrangements in which the tip portions 136 of the teeth structures 135 face the central axis of the positioning fastener member 110 as well as the angle θ between the teeth structures 135 of two clip members 112 adjacent to each other parallel to the cross-section of the positioning fastener member 110 is less than or equal to 120 degrees, the tip portions 136 of the teeth structures 135 of all the clip members 112 can abut against each other on the central axis when the clip members 112 are squeezed by the outer cover 120 to be close to each other. Thus, the teeth structures 135 can accurately penetrate into the inner material of the strap so as to prevent the strap from loosening from the positioning fastener member 110 during use. Furthermore, a long axis of each of the teeth structures 135 can be perpendicular to the inner arc surface 134 where the teeth structures 135 are disposed, and the three teeth structures 135 can be disposed along a central axis of each of the clip members 112. Thus, the fixing force of the clip members 112 to the strap is more even, but the present disclosure is not limited thereto.

Figure 10:
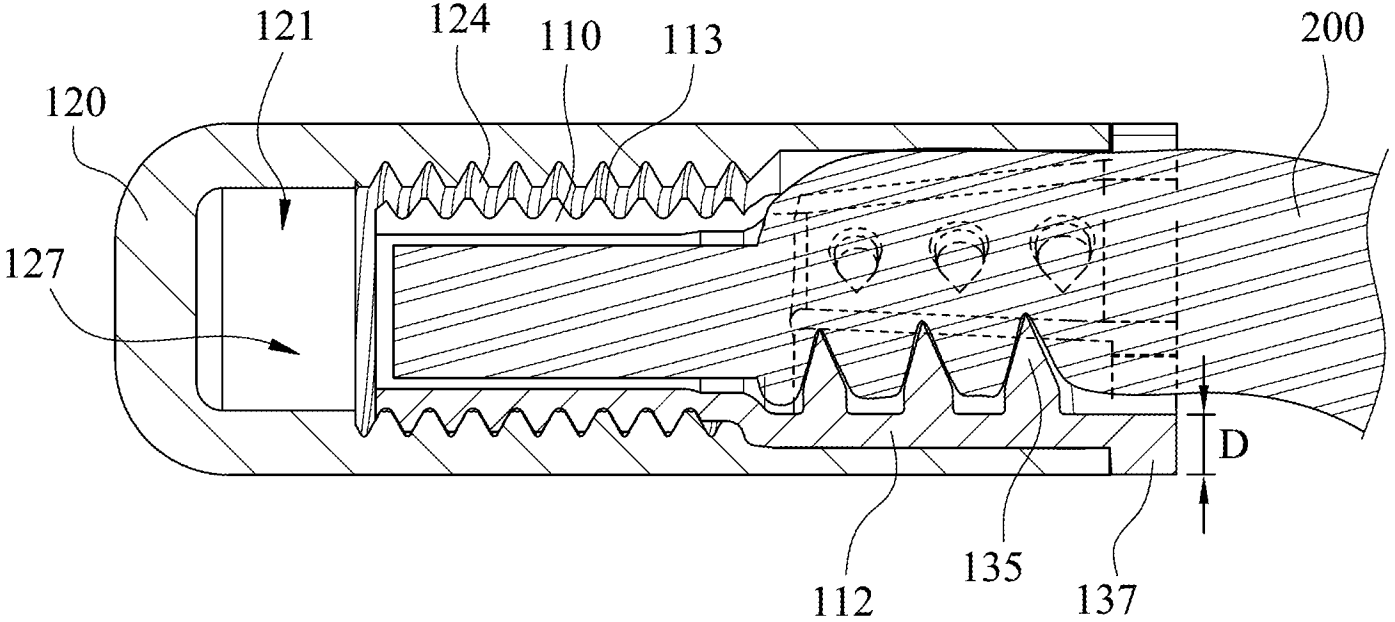
FIG. 10 is a cross-sectional view of the strap tip structure of FIG. 8 along a cutting line 10-10.

As further shown in FIG. 3, each of the clip members 112 can further include a protruding structure 137, and the protruding structure 137 is disposed on the end portion 133 of each of the clip members 112. Such a configuration is favorable for providing a position for applying a force during the assembly of the positioning fastener member 110 and the outer cover 120, and the use of the strap tip structure 100 of the present disclosure can be convenient. Further, a thickness D (the reference number is shown in FIG. 10) of the protruding structure 137 can be larger than or equal to a thickness of the outer cover 120, so that the appearance of the strap tip structure 100 of the present disclosure is more integral and conducive so as to facilitate subsequent use, but the present disclosure is not limited thereto.

Figure 6:
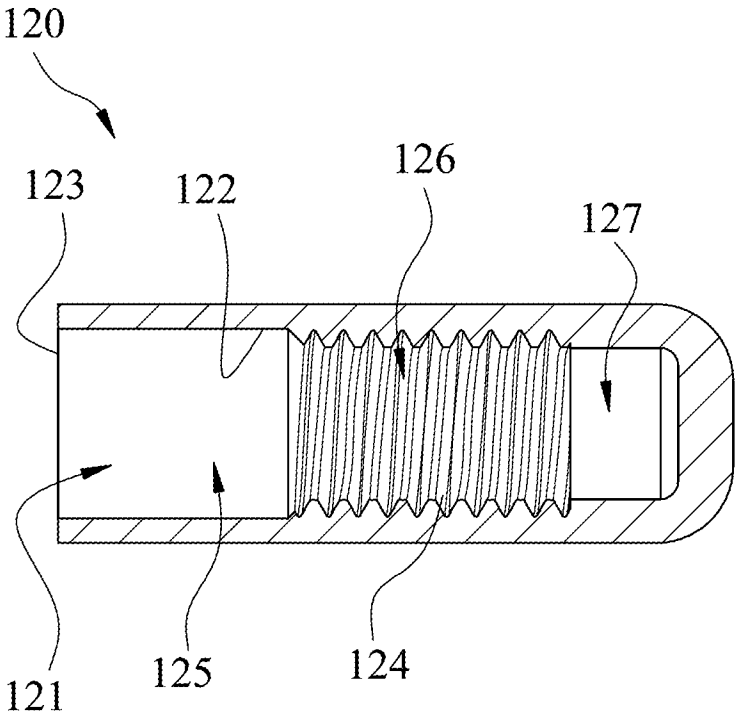
FIG. 6 is a cross-sectional view of the outer cover of FIG. 5 along a cutting line 6-6.
Figure 5:
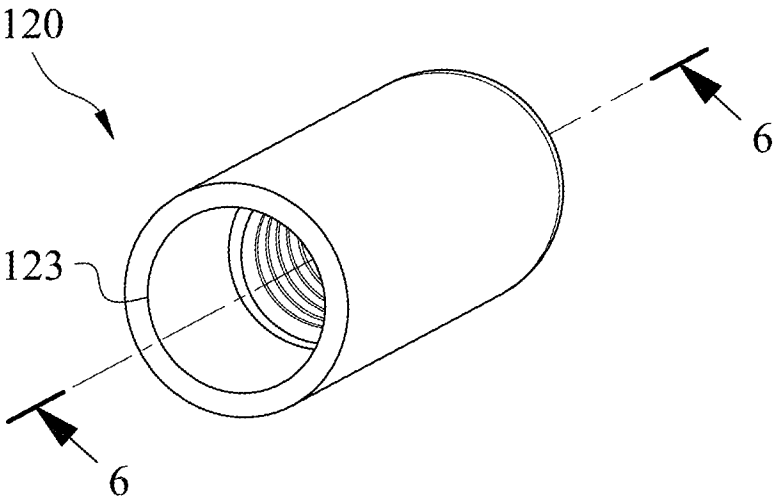
FIG. 5 is a schematic view of an outer cover of the strap tip structure of FIG. 1.

Reference is made to FIG. 1, FIG. 5 and FIG. 6. FIG. 5 is a schematic view of the outer cover 120 of the strap tip structure 100 of FIG. 1, and FIG. 6 is a cross-sectional view of the outer cover 120 of FIG. 5 along a cutting line 6-6. The outer cover 120 is detachably connected to the positioning fastener member 110, wherein the outer cover 120 includes an inner space 121 and an inner screw structure 124. The inner screw structure 124 is disposed on an inner surface 122 of the outer cover 120, and the inner screw structure 124 matches the external screw structure 113 of the positioning fastener member 110. In particular, the inner surface 122 is located in the inner side of the outer cover 120 and defines the inner space 121. When the inner screw structure 124 disposed on the inner surface 122 of the outer cover 120 and the external screw structure 113 disposed on the outer surface of the positioning fastener member 110 are screwed together, the positioning fastener member 110 is accommodated in the inner space 121, and the positioning fastener member 110 along with the strap are covered by the outer cover 120. Therefore, the strap tip structure 100 of the present disclosure has an integral appearance and is conducive to passing through the holes of articles, so that the use thereof is convenient.

As further shown in FIG. 5 and FIG. 6, the inner space 121 of the outer cover 120 includes a first segmental area 125 and a second segmental area 126. The first segmental area 125 is adjacent to an opening 123 of the outer cover 120, and the inner screw structure 124 is located in the second segmental area 126. Accordingly, when the positioning fastener member 110 enters the inner space 121 of the outer cover 120 through the opening 123 and the external screw structure 113 thereof is screwed with the inner screw structure 124 of the outer cover 120, the clip members 112 can be accommodated in the first segmental area 125 of the inner space 121, so that the clip members 112 can be stably and evenly squeezed by the outer cover 120 and then gathered together. At this time, the outer cover 120 can be prevented from moving relative to the positioning fastener member 110 and loosening therefrom due to the abutting force between the clip members 112 and the outer cover 120, such that the structural strength of the strap tip structure 100 of the present disclosure can be enhanced. Further, the inner space 121 of the outer cover 120 can further include a third segmental area 127, and the second segmental area 126 is located between the first segmental area 125 and the third segmental area 127. Thus, such a configuration is favorable for reserving a space for the deformation and displacement of the strap after being squeezed by the positioning fastener member 110. Furthermore, a side of the outer cover 120 different from the opening 123 can be designed as the shape of an arc-shaped bullet so as to facilitate the strap passing through the holes of articles, but the present disclosure is not limited thereto.

Therefore, by the detachable arrangement between the positioning fastener member 110 and the outer cover 120 of the strap tip structure 100 of the present disclosure, the need for the use of glue, films and other methods to fix the head of the structure head of the conventional webbing strap can be eliminated. Thus, the configuration of the present disclosure is not only more convenient in processing and manufacturing but also friendly to the environment. Further, the arrangement in which the clip members 112 are flexibly connected to the mainbody 111 is favorable for providing a sufficient space to place the strap within the positioning fastener member 110 before the assembly thereof. Also, when the positioning fastener 110 is screwed together with the outer cover 120, at least three clip members 112 can be squeezed by the outer cover 120 and taken into the inner space 121. Accordingly, the at least three clip members 112 of the positioning fastener 110 can further clamp the strap, making assembly convenient. Furthermore, by the arrangement in which each of the clip members 112 includes the teeth structures 135, the teeth structures 135 can position the strap when the strap is placed in the strap positioning space 131, and the teeth structures 135 can further penetrate into the inner material of the strap when the clip members 112 are squeezed by the outer cover 120 subsequently. Thus, the effect of fixing the strap can be enhanced, and the strap tip structure 100 of the present disclosure has excellent market application potential. Moreover, any excessive length of the strap can be cut off by the user according to actual needs, and the positioning fastener member 110 and the outer cover 120 can be further installed on the end of the strap after cutting. Thus, convenience of use and the application range and of the strap tip structure 100 of the present disclosure can be greatly improved.

Figure 7:
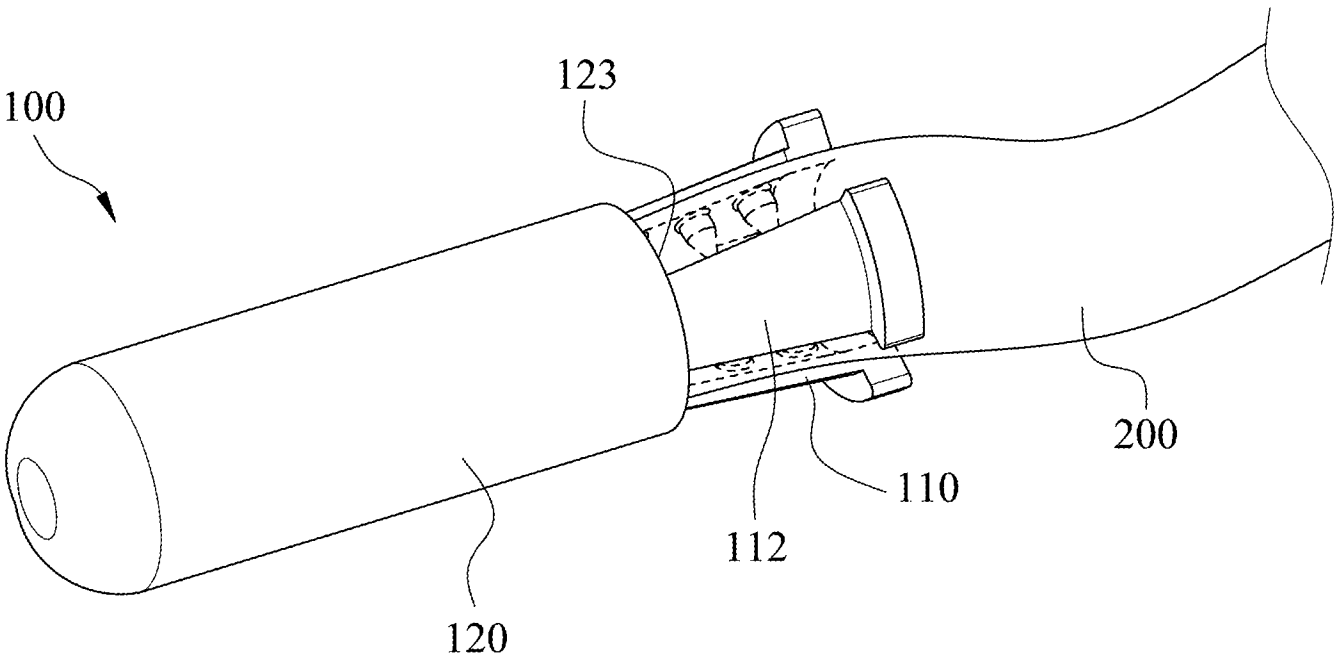
FIG. 7 is an assembling schematic view of the strap tip structure of FIG. 1 applied on a strap.
Figure 8:
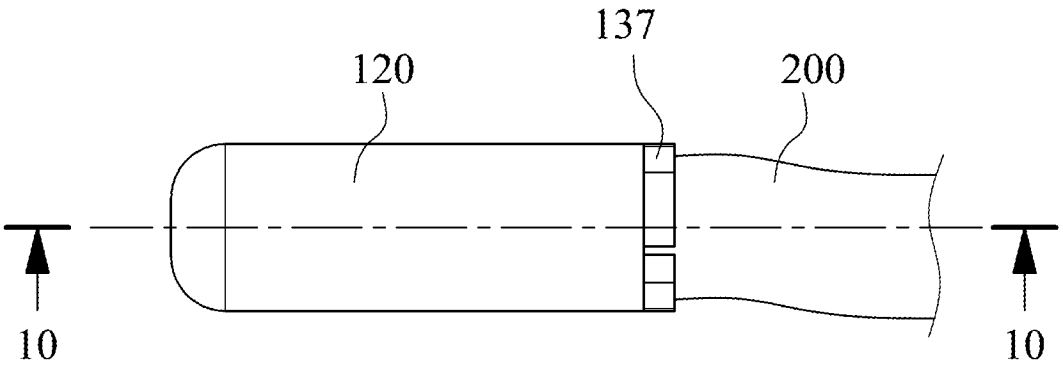
FIG. 8 is a schematic view of the strap tip structure of FIG. 1 connected to the strap.
Figure 9:
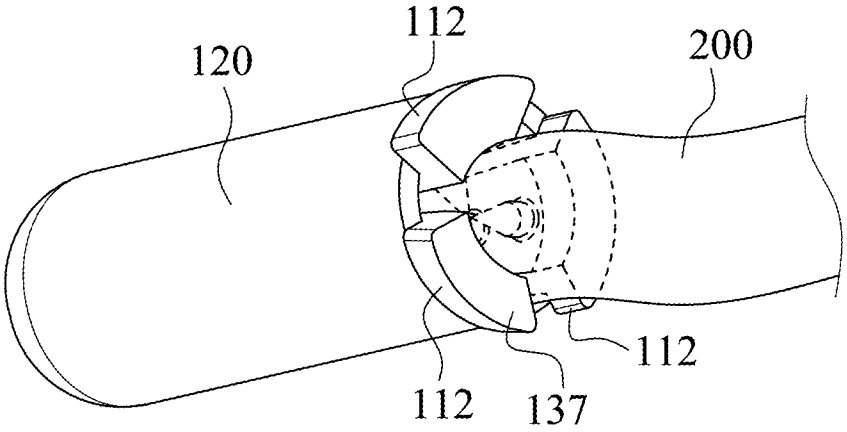
FIG. 9 is another schematic view of the strap tip structure of FIG. 1 connected to the strap.

Reference is made to FIG. 2, FIG. 6, FIG. 7, FIG. 8, FIG. 9 and FIG. 10. FIG. 7 is an assembling schematic view of the strap tip structure 100 of FIG. 1 applied on a strap 200, FIG. 8 is a schematic view of the strap tip structure 100 of FIG. 1 connected to the strap 200, FIG. 9 is another schematic view of the strap tip structure 100 of FIG. 1 connected to the strap 200, and FIG. 10 is a cross-sectional view of the strap tip structure 100 of FIG. 8 along a cutting line 10-10.

First as shown in FIG. 2, FIG. 6 and FIG. 7, when the strap tip structure 100 is to be installed on the strap 200, the head of the strap 200 will be placed within the strap positioning space 131 of the positioning fastener member 110, and the positioning fastener member 110 will enter the inner space 121 through the opening 123 of the outer cover 120 in a state in which the mainbody 111 faces toward the outer cover 120. At the same time, the three clip members 112 of the positioning fastener member 110 are squeezed by the outer cover 120 and then move towards the central axis of the positioning fastener member 110, so that the strap 200 can be covered and wrapped by the three clip members 112. Next, as the positioning fastener member 110 enters the inner space 121 of the outer cover 120, the inner screw structure 124 of the outer cover 120 and the external screw structure 113 of the positioning fastener member 110 are screwed together so as to finish the installation of the strap tip structure 100.

As further shown in FIG. 8, FIG. 9 and FIG. 10, when the installation of the strap tip structure 100 is finished, the three clip members 112 wrap and surround the strap 200 equidistantly, wherein the end portion 133 of each of the clip members 112 protrudes from the outer cover 120, and the protruding structures 137 of the end portions 133 are exposed outside the outer cover 120 and aligned with an edge of the outer cover 120. Accordingly, when the outer cover 120 is to be disassembled from the positioning fastener member 110, the three protruding structures 137 of the clip members 112 can serve as the position for applying a force generated from the fingers of a user or from a machine. Therefore, the assembly and the use of the strap tip structure 100 of the present disclosure can be convenient.

Further, as shown in FIG. 10, when the inner screw structure 124 of the outer cover 120 and the external screw structure 113 of the positioning fastener member 110 are screwed with each other completely, the three clip members 112 will stably abut against the inner surface 122 of the outer cover 120, and the protruding structure 137 will abut against the edge of the outer cover 120. At this time, the teeth structures 135 will penetrate into the inner material of the strap 200 so as to stably position the strap 200 in the positioning fastener member 110. Further, because the third segmental area 127 of the inner space 121 of the outer cover 120 is closed by the positioning fastener member 110 and the strap 200, if the strap 200 is deformed due to the force applied from the positioning fastener member 110, the deformed part of the strap 200 can further extend to the third segmental area 127. Therefore, the installation margin of the strap tip structure 100 of the present disclosure used on the strap 200 is greatly improved and the strap tip structure 100 has excellent market application potential.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A strap tip structure, comprising:

a positioning fastener member having a strap positioning space and comprising:

a mainbody having an accommodating space;

at least three clip members flexibly connected to the mainbody, wherein each of the at least three clip members is an arc plate and has an end portion, and the end portion is away from the mainbody; and an external screw structure disposed on an outer surface of the mainbody;

wherein the positioning fastener member gradually expands along a direction from the mainbody to the end portion of each of the at least three clip members, the accommodating space and the at least three clip members define the strap positioning space, and the strap positioning space is for positioning a strap; and an outer cover detachably connected to the positioning fastener member, wherein the outer cover comprises an inner space and an inner screw structure, the inner screw structure is disposed on an inner surface of the outer cover, and the inner screw structure matches the external screw structure;

wherein when the inner screw structure of the outer cover and the external screw structure of the positioning fastener member are screwed together, the positioning fastener member is accommodated in the inner space, and the end portion of each of the at least three clip members protrudes from the outer cover.

2. The strap tip structure of claim 1, wherein the positioning fastener member further comprises:

a flexible connecting portion, wherein the at least three clip members are connected to the mainbody through the flexible connecting portion.

3. The strap tip structure of claim 1, wherein the at least three clip members are separated from each other and integrally connected to the mainbody equidistantly, and a width of the end portion of each of the at least three clip members perpendicular to a long axis of the mainbody is less than ⅓ of a circumference of the mainbody.

4. The strap tip structure of claim 1, wherein each of the at least three clip members comprises:

an inner arc surface facing the strap positioning space; and at least two teeth structures disposed on the inner arc surface, wherein the at least two teeth structures are respectively arranged along a long axis of each of the at least three the clip members.

5. The strap tip structure of claim 4, wherein each of the teeth structures comprises a tip portion, and the tip portions of the teeth structures of the at least three clip members face toward a central axis of the positioning fastener member.

6. The strap tip structure of claim 4, wherein an angle between one of the teeth structures of one of the clip members and one of the teeth structures of another one of the clip members adjacent thereto parallel to a cross-section of the positioning fastener member is less than or equal to 120 degrees.

7. The strap tip structure of claim 1, wherein each of the at least three clip members comprises:

a protruding structure disposed on the end portion of each of the at least three clip members.

8. The strap tip structure of claim 1, wherein the mainbody is substantially a cylindrical cotter pin.

9. The strap tip structure of claim 1, wherein the inner space of the outer cover comprises a first segmental area and a second segmental area, the first segmental area is adjacent to an opening of the outer cover, and the inner screw structure is located in the second segmental area.

10. The strap tip structure of claim 9, wherein the inner space of the outer cover further comprises a third segmental area, and the second segmental area is located between the first segmental area and the third segmental area.

* * * * *